US011235582B2

(12) United States Patent
Janssen et al.

(10) Patent No.: US 11,235,582 B2
(45) Date of Patent: Feb. 1, 2022

(54) DETECTING INK STATES FOR PRINTERS BASED ON MONITORED DIFFERENTIAL PRESSURES

(71) Applicant: HEWLETT-PACKARD DEVELOPMENT COMPANY, L.P., Spring, TX (US)

(72) Inventors: Matthew J. Janssen, Corvallis, OR (US); James R. Cole, Corvallis, OR (US); James W. Ring, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 2 days.

(21) Appl. No.: 16/650,256

(22) PCT Filed: Sep. 25, 2017

(86) PCT No.: PCT/US2017/053180
§ 371 (c)(1),
(2) Date: Mar. 24, 2020

(87) PCT Pub. No.: WO2019/059940
PCT Pub. Date: Mar. 28, 2019

(65) Prior Publication Data

US 2021/0197576 A1 Jul. 1, 2021

(51) Int. Cl.
*B41J 2/175* (2006.01)

(52) U.S. Cl.
CPC ..... *B41J 2/17566* (2013.01)

(58) Field of Classification Search
CPC ..... B41J 2/17566; B41J 2/14032
See application file for complete search history.

(56) References Cited

U.S. PATENT DOCUMENTS

| | | | |
|---|---|---|---|
| 6,003,984 A | 12/1999 | Bohorquez et al. | |
| 6,467,861 B1 | 10/2002 | Thielman et al. | |
| 6,988,793 B2 | 1/2006 | Wilson et al. | |
| 2008/0136860 A1 | 6/2008 | Kyoso | |
| 2016/0207317 A1* | 7/2016 | Miravet Jimenez | B41J 2/18 |
| 2017/0008297 A1* | 1/2017 | Angulo Navarro | B41J 2/17566 |

FOREIGN PATENT DOCUMENTS

| | | |
|---|---|---|
| EP | 1409257 | 4/2004 |
| JP | 2017087678 A | 5/2017 |

OTHER PUBLICATIONS

"Measurement of Level in a Tank Using Capacitive Type Level Probe", Mar. 18, 2011, http://coep.vlab.co.in/?sub=33&brch=91&sim=449&cnt=1; downloaded Aug. 21, 2017; 4 pp.

* cited by examiner

*Primary Examiner* — Jason S Uhlenhake
(74) *Attorney, Agent, or Firm* — Trop Pruner & Hu PC

(57) ABSTRACT

A technique includes coupling outlets of a first ink supply and a second ink supply together to provide ink to a printhead of a printer; and pressurizing the first ink supply and the second ink supply with air so that an air pressure of the first ink supply has a different air pressure than an air pressure of the second ink supply. The technique includes monitoring an ink-to-air differential pressure of the first ink supply or the second ink supply; and detecting an ink state for the printer based on the monitored ink-to-air differential pressure.

14 Claims, 6 Drawing Sheets

DETECTING INK STATES FOR PRINTERS BASED ON MONITORED DIFFERENTIAL PRESSURES

BACKGROUND

An inkjet printer typically contains an ink reservoir to supply ink to a printhead of the printer. The ink reservoir may be contained in a print cartridge, or for a bulk ink, inkjet printer, the ink reservoir may be separate from the ink reservoir. For such purposes as protecting the printhead and preventing the ink from running out while printing a document, and to notify the user, the printer may contain a mechanism to detect an out of ink state before the supply of ink to the printhead is entirely depleted.

DETAILED DESCRIPTION

Figure 1:
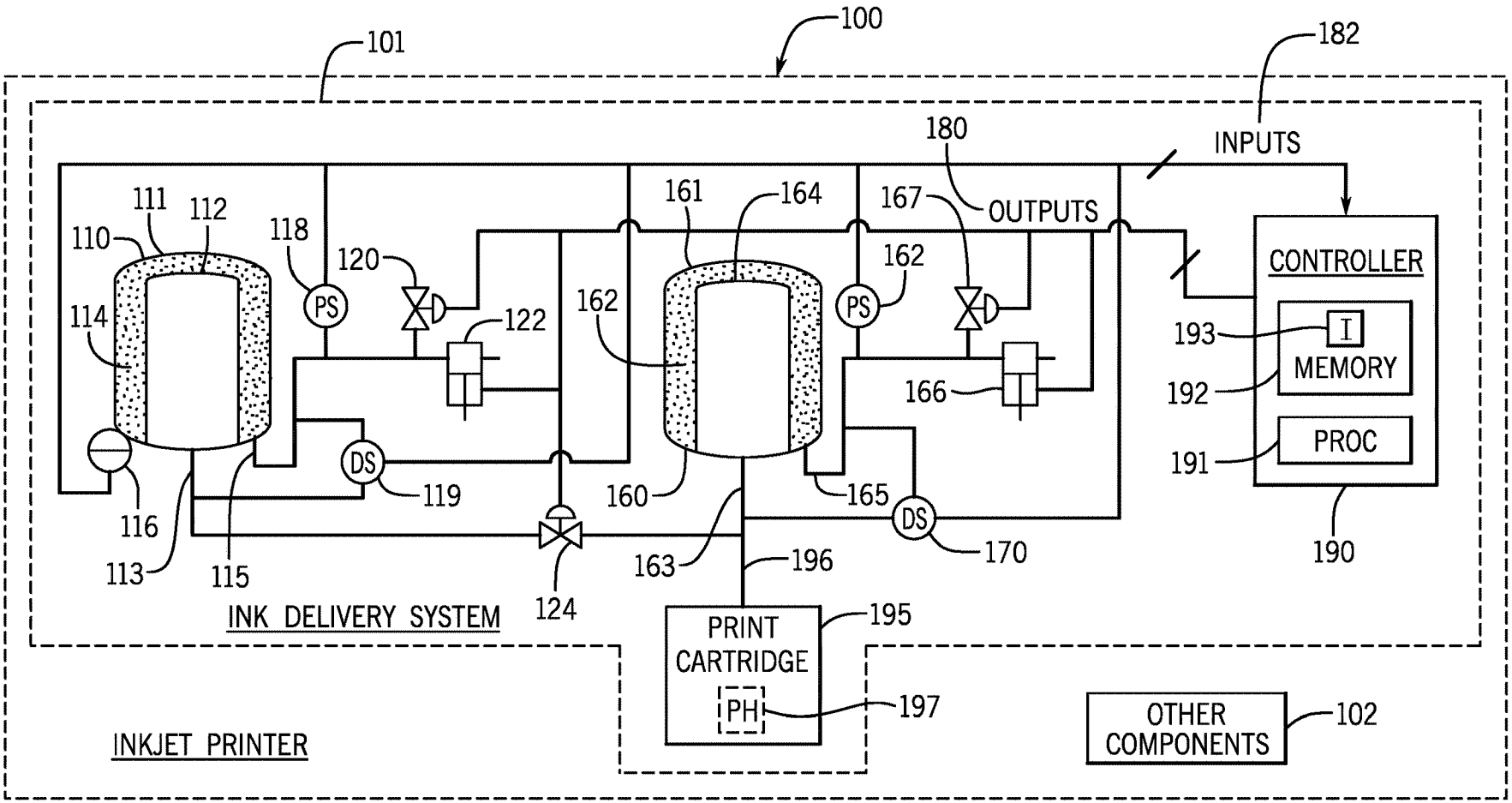
FIG. 1 is a schematic diagram of an ink jet printer according to an example implementation.

An inkjet printer may contain a mechanism to detect an ink state, such as an out of ink (OOI) state, for an ink reservoir, or supply, of the printer. In this context, the "ink state" refers to a characterization of the ink level of the ink supply, and the "OOI state" refers to an ink state for which the ink supply is sufficiently depleted so that the ink supply may no longer be reliably used to supply ink to the printhead without refilling the ink supply with ink or replacing the ink supply. The inkjet printer may use a bulk ink supply in which ink is supplied to the printhead through an ink supply that is separate from the print cartridge containing the printhead. In this manner, the ink supply may include a pressure containing vessel (a rigid plastic container, for example) and an ink bag that is disposed inside the vessel. The vessel may be pressurized with air, which surrounds the ink bag, so that the air pressure exerts a force on the ink bag to force ink from the ink supply.

In accordance with example implementations that are described herein, an inkjet printer contains a primary ink supply and a backup, or auxiliary, ink supply. In accordance with example implementations, the existence of the auxiliary ink supply allows the primary ink supply to be fully depleted. In this manner, primary and auxiliary ink supplies may have associated ink outlets that are connected to a manifold that supplies ink to a printhead of the printer; and the primary and auxiliary ink supplies may be pressurized at different air pressures. More specifically, the primary ink supply may have a higher associated air pressure than the auxiliary ink supply so that the ink from the primary ink supply is depleted first before the auxiliary ink supply furnishes ink to the printhead.

In accordance with example implementations that are described herein, the air pressure difference between the primary and auxiliary ink supplies allows a sensed ink-to-air pressure of one of the ink supplies to be used for purposes of detecting an OOI differential state of the primary ink supply.

More specifically, in accordance with example implementations, the ink-to-air differential pressure of the primary ink supply may be monitored for purposes of detecting an OOI state for the primary ink supply. When the primary ink supply has a sufficient ink level (a full ink level, for example), the ink-to-air differential pressure of the primary ink supply is near or at a zero pressure level. However, as the ink level of the primary ink supply is depleted so that the primary ink supply approaches the OOI state, the ink-to-air differential pressure of the primary ink supply rapidly increases to approach the air pressure difference between the primary and auxiliary ink supplies. In accordance with example implementations, the OOI state may be detected by detecting a pressure rise in the primary supply's ink-to-air differential pressure, which is equal or near the air pressure difference between the two ink supplies. In accordance with further example implementations, the OOI state may be detected by detecting a relatively sharp, or abrupt, transition in a relationship, or curve, of the primary ink supply's ink-to-air differential pressure versus the volume of ink that is delivered to the printhead.

The ink-to-air differential pressure of the auxiliary ink supply may be monitored (in lieu of monitoring the ink-to-air differential pressure of the primary ink supply) for purposes of detecting an OOI state for the primary ink supply, in accordance with further example implementations. As described further herein, the ink-to-air differential pressure of the auxiliary ink supply exhibits a relatively small, if any, change as a function of the volume of ink that is provided to the printhead, as long as the ink level in the primary ink supply is not sufficiently depleted (i.e., as long as the primary ink supply has not reached the OOI state). However, as the ink level of the primary supply approaches a level associated with an OOI state, the ink-to-air differential pressure of the auxiliary ink supply rapidly increases. In accordance with example implementations, the OOI state may be detected by detecting a relatively sharp, or abrupt, transition in the relationship, or curve, of the ink-to-air differential pressure of the auxiliary ink supply versus the volume of ink that is delivered to the printhead.

In accordance with example implementations, the OOI state detection systems and techniques that are described herein may obviate sensor characterization and corresponding sensor calibration at the factory. Moreover, the OOI state detection systems and techniques that are described herein may produce less residual "stranded" ink in the primary ink supply, thereby reducing the environmental impact associated with an empty supply and improving the customer experience with the printer.

As a more specific example, FIG. 1 depicts an inkjet printer 100 in accordance with example implementations. In general, the inkjet printer 100 includes an ink delivery system 101 and other components 102, such as a firing system (the electronics and software that fires the pen to produce an image on paper). In general, the ink delivery system 101 includes a print cartridge 195, which contains a printhead 197. Ink to the printhead 197 may be supplied through one of two ink reservoirs, or supplies: a primary ink supply 110; and a backup, or auxiliary, ink supply 160. In this manner, the printhead 197 is connected to the outlet 196 of a manifold, which has an inlet that is connected to an ink outlet 113 of the primary ink supply 110 and an inlet that is connected to an ink outlet 163 of the auxiliary ink supply 160.

The primary ink supply 110 and the auxiliary ink supply 160 have different associated air pressures: the air pressure of the primary ink supply 110 is greater than the air pressure of the auxiliary ink supply 160 to cause ink from the primary ink supply 110 to be furnished to the printhead 197 (in lieu of ink from the auxiliary ink supply 160), as long as the primary ink supply 110 has not reached the OOI state. When the ink from the primary ink supply 110 is depleted (i.e., the primary ink supply 110 reaches the OOI state), the auxiliary ink supply 160 then supplies the ink to the printhead 197.

The primary ink supply 110 may include a pressure containing vessel 111, such as a rigid plastic container, and an ink bag 112 that may be disposed inside the vessel 111. The ink bag 112 is connected to supply ink to the outlet of the vessel 111, which forms the outlet 113 of the primary ink supply 110. The vessel 111 also contains an inlet 115 that is in fluid communication with an air pump 122 of the printer 100 and in fluid communication with an air containing region 114 inside the vessel 111. A controller 190 of the ink delivery system 101 controls the on/off operation of the air pump 122 and venting by an air release valve 120 based on a signal that is provided by a primary air supply pressure sensor 118 to regulate an air pressure (4 pounds per square inch (psi), for example) in the region 114 of the vessel 111, and this air pressure, in turn, applies a force on the ink that is supplied by the primary ink supply 110.

In a similar manner, the auxiliary ink supply 160 may include a pressure containing vessel 161, such as a rigid plastic container, and an ink bag 164 that may be disposed inside the vessel 161. The ink bag 164 is connected to supply ink to an outlet of the vessel 161, which forms the ink outlet 163 of the auxiliary ink supply 160. The vessel 161 also contains an inlet 165 that is in fluid communication with an air pump 166 of the ink delivery system 101 and is in fluid communication with an air containing region of the vessel 161. In this manner, the controller 190 may control the on/off operation of the air pump 166 and venting via an air valve 167 based on a pressure signal provided by an air pressure sensor 162 to regulate an air pressure (2 pounds per square inch (psi), for example) inside the vessel 161, and this air pressure, in turn, applies a force on the ink that is supplied by the auxiliary ink supply 160.

Due to the air pressure difference (2 psi, for example) between the primary ink supply 110 and the auxiliary ink supply 160, the primary ink supply 110 is biased to furnish ink to the printhead 197 until the supply 110 reaches the OOI state, and when this occurs, the auxiliary ink supply 160 furnishes the ink to the printhead 197.

More specifically, in accordance with some implementations, in response to detecting an OOI state for the primary ink supply 110, the controller 190 alerts a user of the printer 100 (by displaying a message, turning on a visual and/or aural indicator, and so forth); isolates the primary ink supply 110 (by closing a valve 124 between the outlet 113 of the primary ink supply 110 and the ink supply line 196 of the printhead 197); and depressurizes the primary ink supply 110 (by opening the air valve 122). The primary ink supply 110 may then be replaced, and in the interim, the auxiliary supply 160 may supply ink to the printhead 197. When the primary ink supply 110 is replaced, the controller 190 may then re-pressurize the primary ink supply 110 (pressurize the air inside the vessel 111 to 4 psi, for example) and open the valve 124 to reestablish ink communication between the primary ink supply 110 and the ink communication manifold. Due to the air pressure difference between the primary ink supply 110 and the auxiliary ink supply 160, at this point, the auxiliary supply 160 ceases providing ink to the printhead 197, and the primary ink supply 110 provides the ink to the printhead 197. Moreover, in accordance with example implementations, due to the air pressure difference between the ink supplies 110 and 160, ink from the primary ink supply 110 may recharge the ink supply of the auxiliary ink supply 160 to a full ink level.

In accordance with example implementations, the printer 100 includes one or multiple ink-to-air differential pressure sensors. For the specific example of FIG. 1, the ink delivery system 101 includes two ink-to-air differential pressure sensors 119 (for the primary ink supply 110) and 170 (for the auxiliary ink supply 160). As described further herein, the controller 190 may monitor the ink-to-air differential pressure sensed by either differential pressure sensor 119 or 170 for purposes of detecting an OOI state for the primary ink supply 110.

In performing its various functions, such as controlling the air pressures of the ink supplies 110 and 160 and detecting the OOI state of the primary ink supply 110, the controller 190 may receive one or multiple inputs 182 (signals representing sensed air pressures of the primary ink supply and the auxiliary ink supply; a signal representing a sensed ink-to-air differential pressure of the primary ink supply or auxiliary ink supply; and so forth) and provide one or multiple outputs 180 (valve control signals, air pump control signals, a signal representing a detected OOI state for the primary ink supply 110, and so forth).

In accordance with some implementations, the controller 190 may include one or multiple hardware processors 191, such as, for example, one or multiple central processing units (CPUs), one or multiple CPU cores, one or multiple microcontrollers, and so forth. In accordance with example implementations, the processor(s) 191 may execute machine executable instructions 193 (or "software"), for purposes of performing one or more of the functions described herein, such as detection of the ink state or OOI state for the primary ink supply 110. The instructions 193 may be stored in a non-transitory memory 192, such as a memory that is formed from semiconductor storage devices, memristor-based memory devices, phase change memory devices, volatile memory devices, non-volatile memory devices, a combination of one or more of the foregoing memory technologies, other memory technologies, and so forth.

In accordance with further example implementations, the controller 190 may be formed in whole or in part from a circuit that does not execute machine executable instructions, such as, for example, a field programmable gate array (FPGA), an application specific integrated circuit (ASIC), and so forth.

In accordance with example implementations, the controller 190 may monitor the ink-to-air differential pressure of the auxiliary pressure supply 160 for purposes of detecting the OOI state of the primary ink supply 110. In other words, in accordance with example implementations, the controller 190 may monitor the differential pressure represented by the output of the differential ink-to-air sensor 170 for purposes of detecting the OOI state of the primary ink supply 110.

A pressure sensor, in general, provides a signal that represents (in millivolts, for example) a pressure that is sensed by the sensor. The pressure sensor, however, may introduce an error (an offset error, a linearity error, another type of error, a combination of errors, and so forth), and accordingly, the pressure sensor may be calibrated before the sensor may be used to provide an accurate absolute pressure measurement. However, in accordance with example implementations, the controller 190 may monitor the signal from the ink-to-air differential pressure sensor 170 and process this signal to detect a sharp, or abrupt, pressure transition that represents the OOI state for the primary ink supply 110, without relying on the sensor 170 being calibrated.

More specifically, in accordance with example implementations, the controller 190 uses a combination of the ink-to-air differential pressure (as represented by the signal from the sensor 170) and an estimation of the volume of ink delivered to the printhead 197 to construct a curve, or representation, of the ink-to-air differential pressure versus the delivered ink volume. It is noted that the controller 190 has an estimate of the delivered ink volume due to the knowledge of the number of ink drops provided at the printhead 197. Although the delivered ink volume (as determined from the number of ink drops) may provide a coarse estimate of the ink level of the primary ink supply 110 (an estimate that has an accuracy of ±20%, for example), the controller 190 uses the delivered ink volume in combination with the signal from the pressure sensor 170 to provide a relatively finer (i.e., more accurate) estimate of the ink level, and in particular, a relatively accurate detection of the OOI state. In this manner, in accordance with example implementations, the controller 190 uses the delivered ink volume and the signal from the sensor 170 to detect a relatively abrupt transition in the ink-to-air pressure of the auxiliary ink supply 160, which coincides with the primary ink supply 110 reaching an OOI state.

Figure 2:
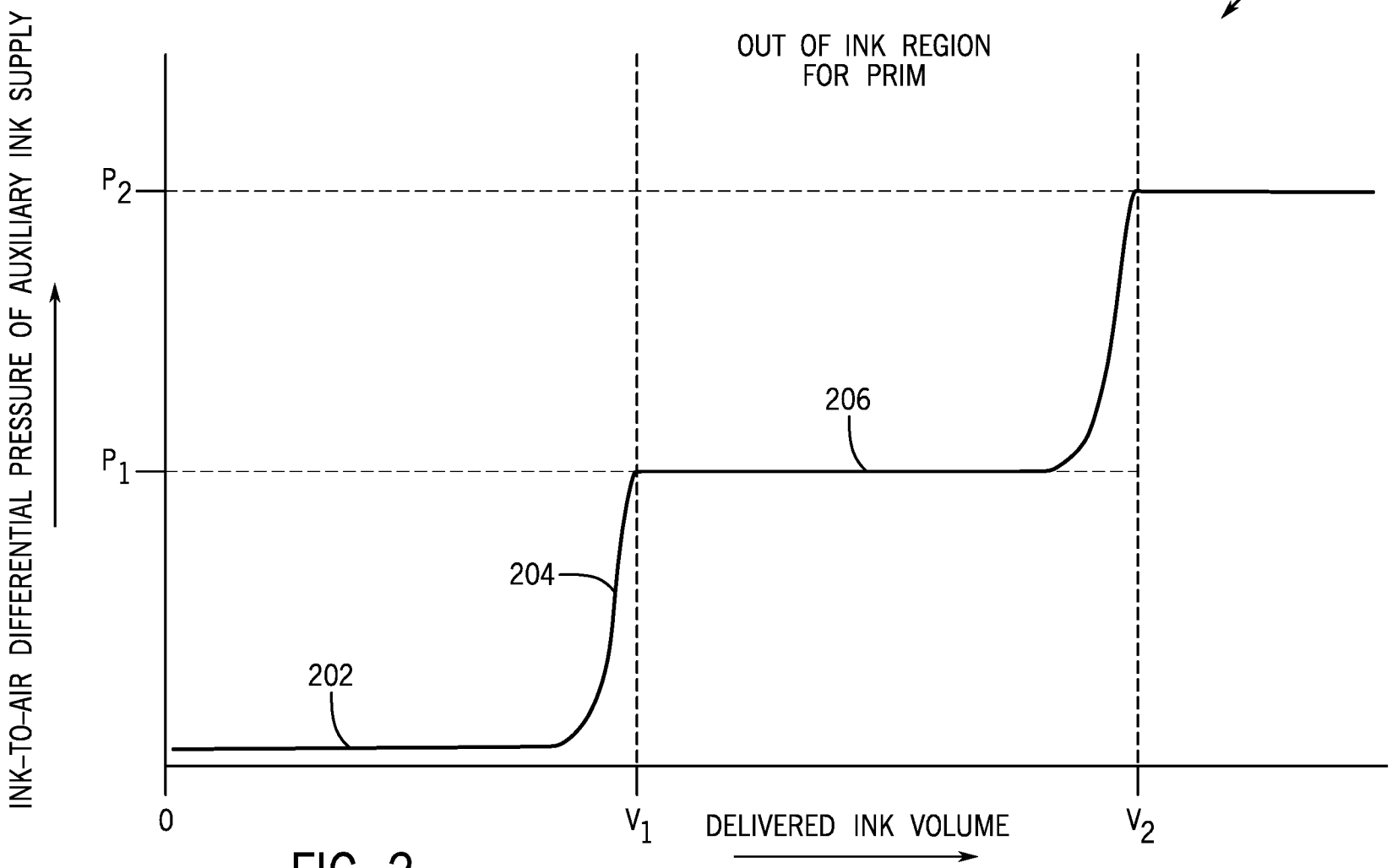
FIG. 2 depicts an ink-to-air differential pressure of an auxiliary ink supply of the printer versus a volume of ink delivered to a printhead of the printer according to an example implementation.

As a more specific example, FIG. 2 depicts a representation, or curve 200, of the auxiliary ink-to-air differential pressure (as represented by the signal from the pressure sensor 170) versus the delivered ink volume to the printhead 197. The curve 200 has two "flat" regions, or regions in which the auxiliary ink-to-air differential pressure is constant or nearly constant with respect to the delivered ink volume. Initially, when the primary ink supply 110 is full, the pressure remains within a first flat region 202 and thus, varies little with respect to the delivered ink volume. The flat region 202 corresponds to the delivery of ink to the printhead 197 from the primary ink supply 110. When the primary ink supply 110 approaches the OOI state (near a delivered ink volume $V_1$), the pressure rapidly rises (exponentially rises, for example), and the curve 200 has an abrupt transition 204 to another relatively flat pressure region 206 (corresponding to the auxiliary ink supply providing ink to the printhead 197) until the auxiliary ink supply 160 reaches an OOI state at a delivered ink volume $V_2$.

In accordance with some implementations, the controller 190 may detect the transition 204 as follows. First, it is noted that the controller 190 may generally be aware of the current position on the curve 200 due to the knowledge of the current delivered ink volume (the controller 190 may assume that the curve 200 is in the first flat region 202, for example, due to knowledge that less than one half of the initial volume of ink in the primary ink supply 110 has been delivered to the printhead 197, for example). The controller 190 may condition the signal that is provided by the pressure sensor 170. For example, in accordance with some implementations, the controller 190 may apply a low pass filter to the signal provided by the sensor 170 and "ratchet" the filtered signal to hold the maximum value of the filtered signal. Next, the controller 190 may determine the first order differential of the resulting conditioned pressure signal, i.e., derive a signal representing the rate of change of the conditioned pressure signal with respect to the delivered ink volume.

The controller 190 may then sample the rate of change signal to monitor the rate of change signal for two conditions representing the transition 204: a first condition representing the beginning of the transition 204; and a second condition representing the end of the transition 204. More specifically, in accordance with some implementations, the controller 190 may sample the rate of change signal to detect a consecutive sequence of a predetermined number of samples in which each sampled value exceeds a predetermined threshold value. For example, the controller 190 may detect the first condition by monitoring for a certain number consecutive samples of the rate of change signal meeting or exceeding a threshold value of 0.10 to 0.25 psi (or a corresponding millivolt range) per cubic centimeter of delivered ink. When this consecutive sequence is detected, the first condition has been satisfied, and the controller 190 may next monitor for the second condition, i.e., the controller 190 may monitor the rate of change of signal to detect the end of the transition 204 and the beginning of the second flat region 206. In accordance with example implementations, the controller 190 may detect the second condition by monitoring for a certain number of consecutive samples of the rate of change signal, which are below a predetermined threshold value. For example, for purposes of detecting the second condition, the controller 190 may monitor the rate of change signal to detect ten consecutive sampled values that are less than 0.01 psi (or a corresponding millivolt value) per cubic centimeter of delivered ink.

Figure 3:
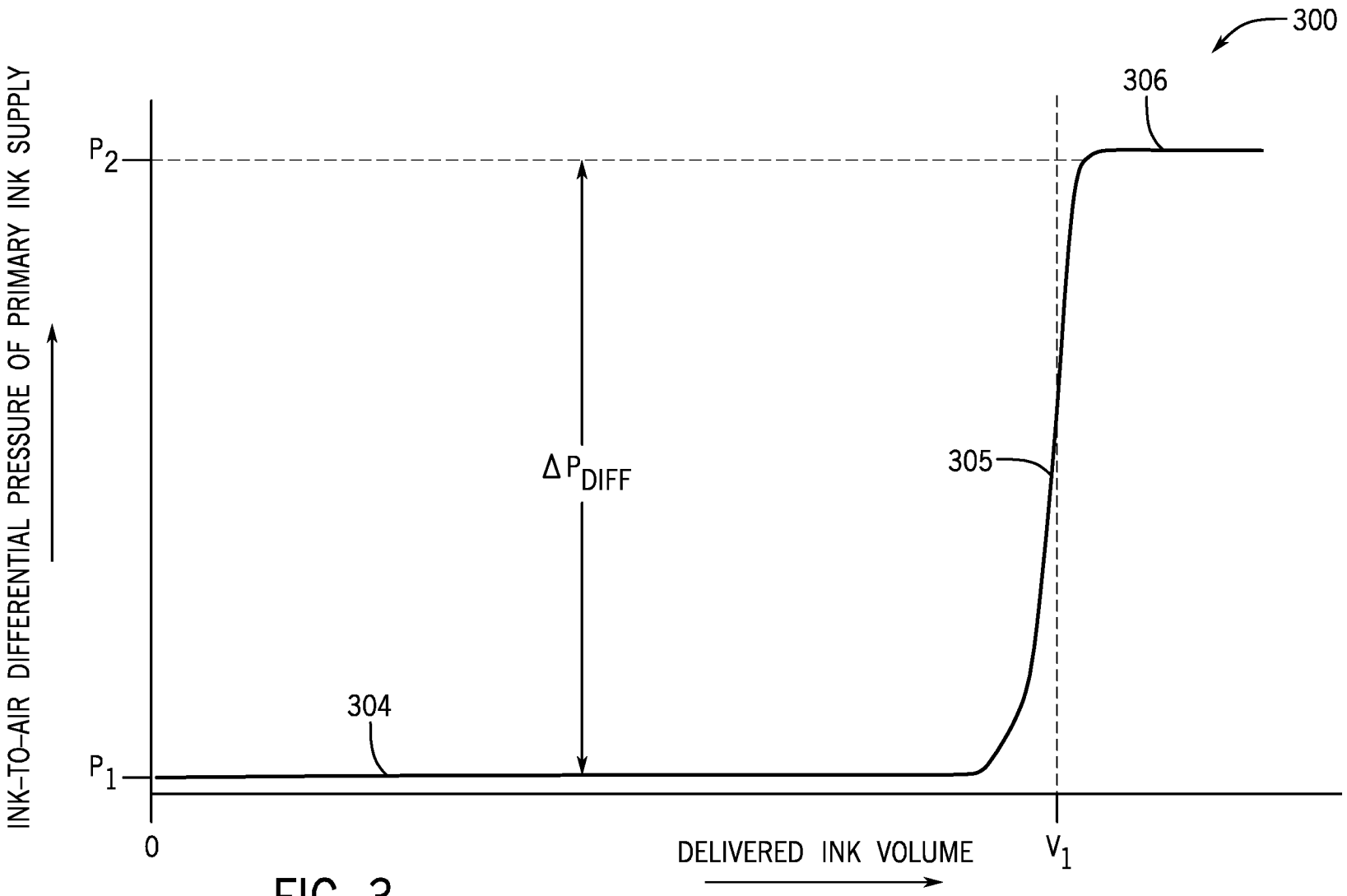
FIG. 3 depicts an ink-to-air differential pressure of the primary ink supply versus a volume of ink delivered to the printhead according to an example implementation.

In accordance with further example implementations, the controller 190 may monitor the differential ink-to-air differential pressure of the primary ink supply 110 (via the differential sensor 119) for purposes of detecting the OOI state for the primary ink supply 110. Referring to FIG. 3, as a more specific example, the controller 190 may construct a curve 300, which represents an ink-to-air differential pressure of the primary ink supply versus a delivered ink volume to the printhead 197. For this example implementation, the controller 190 monitors the constructed curve 300 for purposes of detecting a relatively sharp transition 305 (near a delivered ink volume $V_1$). The transition 305 arises as the primary ink supply 110 reaches the OOI state. In this manner, initially, the ink-to-air differential pressure (indicated by the differential sensor 119) is at a pressure $P_1$ pressure level, which, ideally, if the differential sensor 119 is calibrated, is zero. However, due to an offset error introduced by the differential sensor 119, the pressure $P_1$ may be nonzero. In accordance with some implementations, the controller 190 may coarsely calibrate the differential sensor 119 to cause the $P_1$ pressure to be near zero, although precise calibration may not be used, in accordance with some implementations. In general, until the curve 300 reaches the transition 305, the curve 300 is relatively flat, as indicated at reference numeral 304. Moreover, a pressure difference (called $\Delta PD_{IFF}$ in FIG. 3) exists between the $P_1$ pressure and another pressure level (called "$P_2$" in FIG. 3), which is the air pressure difference between the primary ink supply 110 and the auxiliary ink supply 160.

In accordance with example implementations, the controller 190 may detect the transition 305 by first calibrating the differential pressure sensor 119 such that the sensor 119 provides a signal representing a zero or near zero pressure level for the initial flat region 304; and subsequently, the controller 190 may monitor the curve 300 to detect a pressure increase that is equal to or nearly equal to the air pressure difference between the primary ink supply 110 and the auxiliary ink supply 160.

In accordance with further example implementations, the controller 190 may coarsely calibrate the sensor 119 or not calibrate the sensor 119. Moreover, in accordance with further example implementations, the controller 190 may use the above-described technique discussed above in connection with FIG. 2 to detect the transition 305: i.e., the controller 190 may construct a rate of change signal (representing the change of the ink-to-air differential pressure of the primary supply 110 versus the volume of ink delivered to the printhead 197); monitor the rate of change signal for a consecutive number of sampled rate values greater than or equal to a predefined threshold value to detect a first condition indicative of the beginning of the transition 305; and thereafter, monitor the rate of change signal for a consecutive number of sampled rate values less than or equal to a predefined threshold value to detect a second condition indicative of the end of the transition 305.

Figure 4:
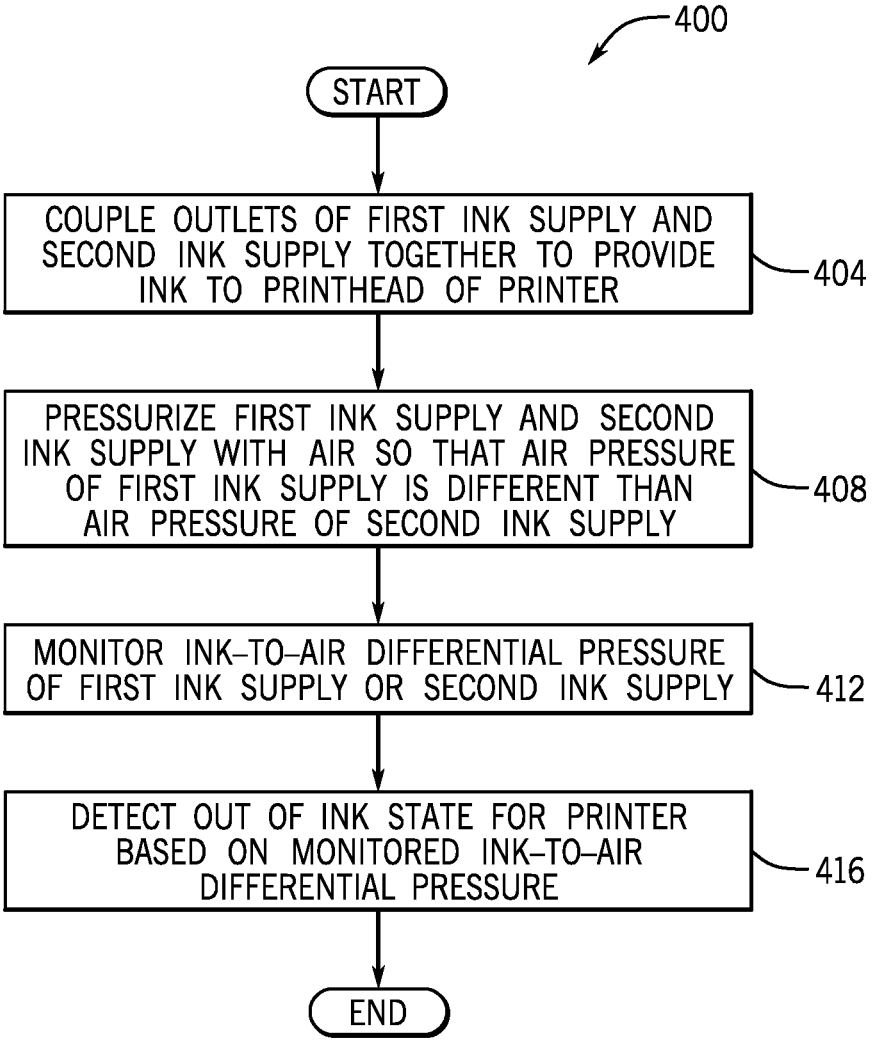
FIG. 4 is a flow diagram depicting a technique to detect an out of ink (OOI) state for a printer on a monitored ink-to-air differential pressure associated with an ink supply of the printer according to an example implementation.

Thus, referring to FIG. 4, in accordance with example implementations, a technique 400 includes coupling (block 404) outlets of a first ink supply and a second ink supply together to provide ink to a printhead of a printer; and pressurizing (block 408) the first ink supply and the second ink supply with air so that an air pressure of the first ink supply is different than an air pressure of the second ink supply. The technique 400 includes monitoring (block 412) an ink-to-air differential pressure of the first ink supply or the second ink supply; and detecting (block 416) an out of ink state for the printer based on the monitored ink-to-air differential pressure.

Figure 5:
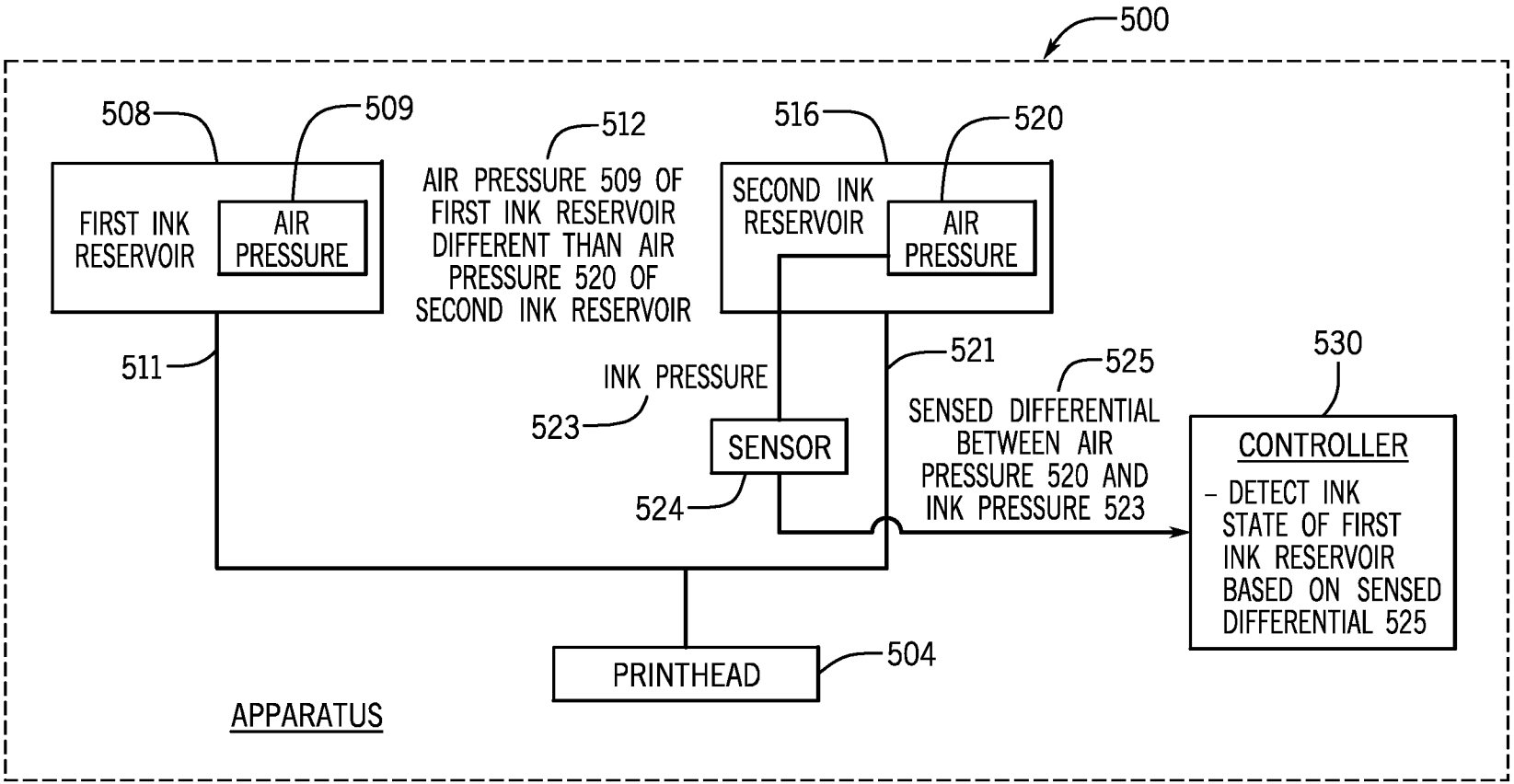
FIG. 5 is a schematic diagram of an apparatus having first and second ink supplies with different associated air pressures and a controller to detect an ink state of the first ink supply based on a sensed ink-to-air differential pressure of the second ink supply according to an example implementation.

Referring to FIG. 5, in accordance with example implementations, an apparatus 500 includes a printhead 504; a first ink reservoir 508; a second ink reservoir 516; a sensor 524 and a controller 530. The first ink reservoir 508 provides ink for the printhead 504 at an ink outlet 511 of the first ink reservoir 508, and the first ink reservoir 508 has an associated first air pressure 509. The second ink reservoir 516 provides ink for the printhead 504 at an ink outlet 521 of the second ink reservoir 516. The second ink reservoir 516 has an associated second air pressure 520 that is less than the first air pressure 509. The senor 524 senses a differential 525 between the air pressure 520 and ink pressure 523 associated with the second ink reservoir 516. The controller 530 detects an ink state for the first ink reservoir 508 based on the sensed differential 525.

Figure 6:
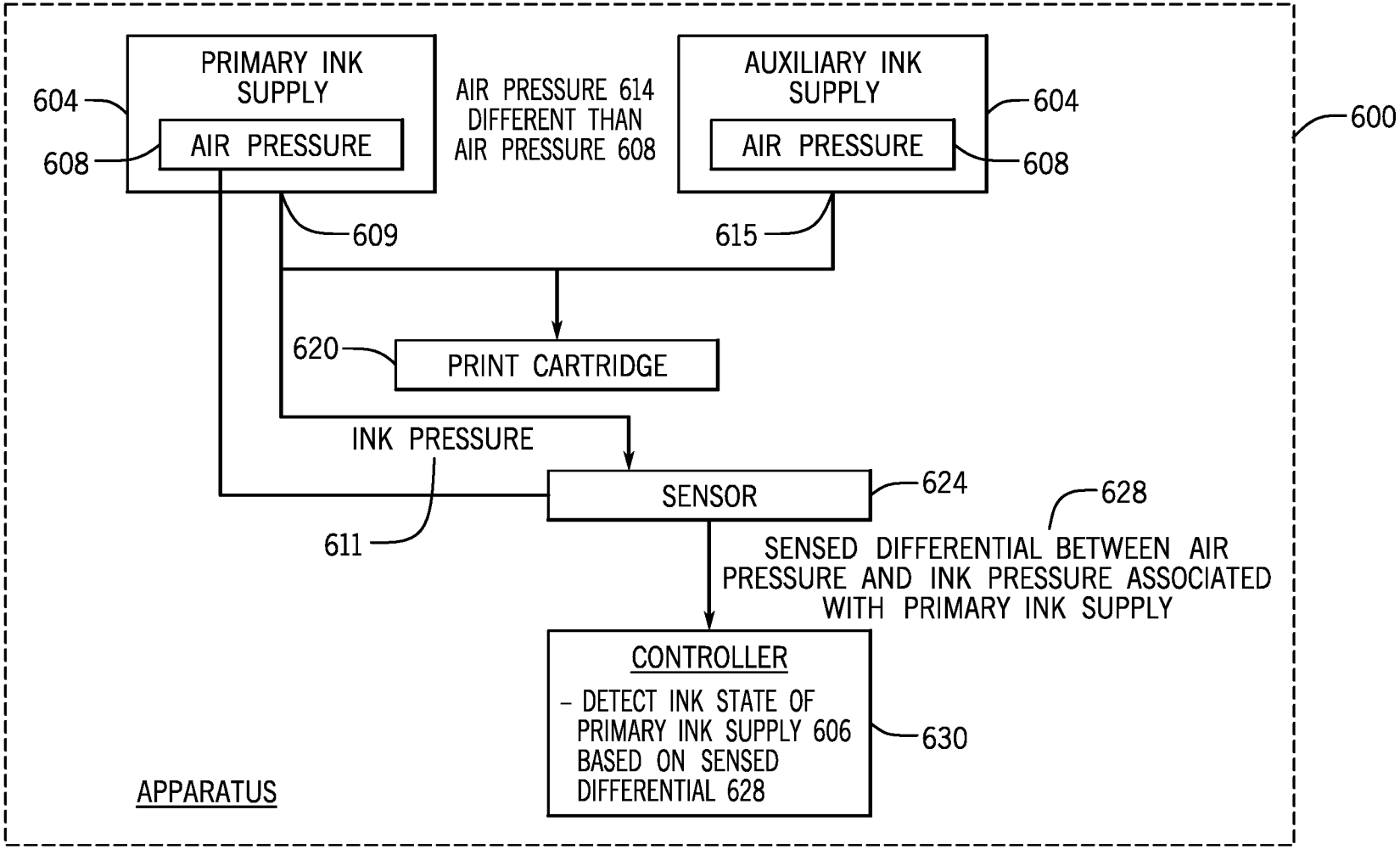
FIG. 6 is a schematic diagram of an apparatus having primary and auxiliary ink supplies with different associated air pressures and a controller to detect an ink state of the primary ink supply based on a sensed ink-to-air differential pressure of the primary ink supply according to an example implementation.

In accordance with further example implementations, an apparatus 600 that is depicted in FIG. 6 includes a print cartridge 620, a primary ink supply 604, an auxiliary ink supply 610, a sensor 624 and a controller 630. The primary ink supply 604 provides ink for the print cartridge 620 at an ink outlet 609 of the primary ink supply 604, and the primary ink supply 604 has an associated air pressure 608. The auxiliary ink supply 610 provides ink for the print cartridge at an ink outlet 615 of the auxiliary ink supply 610, and the auxiliary ink supply 610 has an associated air pressure 614 that is different than the air pressure 608. The sensor 624 senses a differential between the air pressure 608 and an ink pressure 611 associated with the primary ink supply 604. The controller 630 detects a state of the primary ink supply 604 based on the sensed differential 628.

While the present disclosure has been described with respect to a limited number of implementations, those skilled in the art, having the benefit of this disclosure, will appreciate numerous modifications and variations therefrom. It is intended that the appended claims cover all such modifications and variations.

What is claimed is:

1. A method comprising:

coupling outlets of a first ink supply and a second ink supply together to provide ink to a printhead of a printer;

pressurizing the first ink supply and the second ink supply with air so that an air pressure of the first ink supply has a different air pressure than an air pressure of the second ink supply;

monitoring an ink-to-air differential pressure of the first ink supply or the second ink supply; and detecting an out of ink state for the printer based on the monitored ink-to-air differential pressure, wherein detecting the out of ink state comprises:

determining a rate at which the ink-to-air differential pressure changes with respect to a volume of ink delivered to the printhead; and detecting the out of ink state based on the rate at which the ink-to-air differential pressure changes.

2. The method of claim 1, wherein:

the monitored ink-to-air differential pressure comprises a differential pressure associated with the first ink supply; and detecting the out of ink state comprises detecting an out of ink state of the first ink supply.

3. The method of claim 1, wherein detecting the out of ink state further comprises:

sampling the rate at which the ink-to-air differential pressure changes to provide a time succession of samples of the rate at which the ink-to-air differential pressure changes;

determining whether the rate at which the ink-to-air differential pressure changes exceeds a first predetermined rate for a first predetermined number of consecutive samples of the time succession of samples; and detecting the out of ink state based on a result of determining whether the rate at which the ink-to-air differential pressure changes exceeds the first predetermined rate for a first predetermined number of consecutive samples of the time succession of samples.

4. The method of claim 3, wherein:

the rate at which the ink-to-air differential pressure changes exceeds the first predetermined rate for the first predetermined number of consecutive samples, and detecting the out of ink state further comprises:

determining whether the rate at which the ink-to-air differential pressure changes is at or below a second predetermined rate for a predetermined number of consecutive samples of the time succession of samples; and detecting the out of ink state based on a result of determining whether the rate at which the ink-to-air differential pressure changes is at or below the second predetermined rate.

5. The method of claim 1, wherein:

the monitored ink-to-air differential pressure comprises a differential pressure associated with the second ink supply; and detecting the out of ink state comprises detecting an out of ink state of the first ink supply.

6. The method of claim 5, wherein the rate at which the ink-to-air differential pressure changes comprises:

a rate at which the differential pressure associated with the second ink supply changes as a function of ink delivered by the first ink supply.

7. An apparatus comprising:

a print cartridge;

a primary ink supply to provide ink for the print cartridge at an ink outlet of the primary ink supply, the primary ink supply having an associated first air pressure;

an auxiliary ink supply to provide ink for the print cartridge at an ink outlet of the auxiliary ink supply, the auxiliary ink supply having an associated second air pressure different than the first air pressure;

a sensor to sense a differential between the first air pressure and an ink pressure associated with the primary ink supply; and a controller to detect a state of the primary ink supply based on the sensed differential representing a pressure change from an ink-to-air pressure associated with a full ink level for the primary ink supply near or at a predefined pressure difference between the first air pressure and the second air pressure.

8. The apparatus of claim 7, wherein:

the sensor provides a signal representing the differential;

the controller calibrates the signal to provide a calibrated signal so that the calibrated signal when initially calibrated represents the ink-to-air pressure associated with the full ink level for the primary ink supply; and the controller determines an out of ink condition for the primary ink supply based on the calibrated signal representing the pressure change.

9. The apparatus of claim 8, wherein the controller determines the differential versus a volume of delivered ink, and the controller detects the state of the primary ink supply based on the determination.

10. An apparatus comprising:

a printhead;

a first ink reservoir to provide ink for the printhead at an ink outlet of the first ink reservoir, the first ink reservoir having an associated first air pressure;

a second ink reservoir to provide ink for the printhead at an ink outlet of the second ink reservoir, the second ink reservoir having an associated second air pressure different than the first air pressure;

a sensor to sense a differential between the second air pressure and ink pressure associated with the second ink reservoir; and a controller to detect an ink state for the first ink reservoir based on the sensed differential.

11. The apparatus of claim 10, wherein:

the sensed pressure differential varies with ink delivered by the first ink reservoir; and the controller determines whether the sensed pressure differential exhibits a predetermined rate of increase versus the ink delivered; and the controller detects the out of ink state based on determining whether the sensed pressure differential exhibits the predetermined rate of increase.

12. The apparatus of claim 11, wherein the controller:

filters a signal provided by the sensor, wherein the filtered signal represents the sensed pressure differential;

determines a rate of change of the filtered signal versus ink delivered by the first ink reservoir; and detects the out of ink state based on the determined rate of change.

13. A method comprising:

coupling outlets of a first ink supply and a second ink supply together to provide ink to a printhead of a printer;

pressurizing the first ink supply and the second ink supply with air so that an air pressure of the first ink supply has a different air pressure than an air pressure of the second ink supply;

monitoring an ink-to-air differential pressure associated with the first ink supply; and detecting an out of ink state of the first ink supply based on the monitored ink-to-air differential pressure, wherein detecting the out of ink state of the first ink supply comprises detecting whether the differential pressure associated with the first ink supply increases by the pressure difference between the air pressure of the first ink supply and the air pressure of the second ink supply.

14. An apparatus comprising:

a print cartridge;

a primary ink supply to provide ink for the print cartridge at an ink outlet of the primary ink supply, the primary ink supply having an associated first air pressure;

an auxiliary ink supply to provide ink for the print cartridge at an ink outlet of the auxiliary ink supply, the auxiliary ink supply having an associated second air pressure different than the first air pressure;

a sensor to sense a differential between the first air pressure and an ink pressure associated with the primary ink supply; and a controller to detect a state of the primary ink supply based on the sensed differential, wherein the controller to:

determine a rate of transition of the sensed differential versus a volume of delivered ink based on the sensed differential;

determine whether the rate exceeds a predetermined threshold; and detect an out of ink state for the primary ink supply based on a result of the determination.

* * * * *